US010844578B2

(12) United States Patent
Vik

(10) Patent No.: US 10,844,578 B2
(45) Date of Patent: Nov. 24, 2020

(54) CYLINDER PROTECTION DEVICE

(71) Applicant: Caterpillar Inc., Deerfield, IL (US)

(72) Inventor: Timothy Allen Vik, Hopewell, IL (US)

(73) Assignee: Caterpillar Inc., Peoria, IL (US)

( * ) Notice: Subject to any disclaimer, the term of this patent is extended or adjusted under 35 U.S.C. 154(b) by 101 days.

(21) Appl. No.: 16/168,966

(22) Filed: Oct. 24, 2018

(65) Prior Publication Data

US 2020/0131738 A1 Apr. 30, 2020

(51) Int. Cl.

| | |
|---|---|
| ***E02F 9/24*** | (2006.01) |
| ***E02F 9/22*** | (2006.01) |
| ***F15B 15/14*** | (2006.01) |

(52) U.S. Cl.

CPC ..... *E02F 9/24* (2013.01); *E02F 9/2271* (2013.01); *F15B 15/1428* (2013.01)

(58) Field of Classification Search

CPC ... E02F 9/2271; E02F 9/2275; F15B 15/1428; F16F 9/38; B60G 2204/4308

USPC ..... 172/813, 512; 188/322.12

See application file for complete search history.

(56) References Cited

U.S. PATENT DOCUMENTS

| | | | | |
|---|---|---|---|---|
| 2,925,263 | A * | 2/1960 | Blythe | F16F 9/42 267/219 |
| T974,001 | I4 * | 9/1978 | Neal | B62D 21/186 137/377 |
| 6,267,019 | B1 | 7/2001 | Andersen et al. | |
| 6,899,509 | B1 | 5/2005 | Mailleux | |
| 8,408,862 | B1 * | 4/2013 | Westendorf | B66F 9/065 414/722 |
| 2017/0108017 | A1 | 4/2017 | Van Gemert | |
| 2018/0044892 | A1 | 2/2018 | Nishide et al. | |

FOREIGN PATENT DOCUMENTS

| | | | |
|---|---|---|---|
| CN | 205036672 | | 2/2016 |
| DE | 202010016242 | | 3/2014 |
| JP | 2001082413 | | 3/2001 |
| JP | 2007169970 | A * | 7/2007 |
| JP | 4373319 | | 11/2009 |
| JP | 2009263996 | A * | 11/2009 |

OTHER PUBLICATIONS

JP 2007169970 A machine translation to English from espacenet (Year: 2007).*

JP 2009263996 A machine translation to English from espacenet (Year: 2009).*

* cited by examiner

*Primary Examiner* — Abiy Teka

*Assistant Examiner* — Michael Quandt

(74) *Attorney, Agent, or Firm* — Miller, Matthias & Hull

(57) ABSTRACT

A cylinder protection device for a cylinder of a machine includes a cylindrical body. The cylinder protection device includes a first portion having a first surface and a second surface. The first and second surfaces are disposed between a first end and a second end of the first portion. The first and second surfaces are inclined relative to each other. Further, the first and second surfaces intersect at a first upper edge of the first portion. The cylinder protection device also includes a second portion disposed on the cylindrical body and connected to the second end of the first portion. The second portion includes a third surface and a fourth surface inclined relative to each other. Further, the third and fourth surfaces intersect at a second upper edge of the second portion. The second upper edge is inclined relative to the first upper edge of the first portion.

20 Claims, 10 Drawing Sheets

SECTION B–B1

SECTION C-C1

SECTION D-D1

CYLINDER PROTECTION DEVICE

TECHNICAL FIELD

The present disclosure relates to a cylinder protection device for a cylinder of a machine.

BACKGROUND

Machines, such as wheel loaders, excavators, dozers, track type tractors, and the like, generally include cylinders that are used for moving one or more components of a linkage assembly of the machine. The components may include a lift arm or an implement of the machine. During machine operation, the cylinders are exposed to material falling from the implement or other heavy objects, such as large rocks. For example, during demolition work, debris falling on the cylinders may damage the cylinders. Further, the material may also get stuck between the cylinders and another component of the linkage assembly or between the cylinders and a ground surface. Such material may accumulate on the cylinders and when the linkage assembly operates, an external force exerted by the material on the cylinders may bend the cylinders. If the cylinders are repeatedly subjected to bending, the cylinders may eventually fail, thereby increasing machine downtime and maintenance costs associated with the machine.

U.S. Publication Application Number 2018/0044892 describes a bucket cylinder including a cylindrical tube, a rod having a cylindrical boss part mounted to a protruding end side of the rod, and a protective cover having one side supported by a cover guide provided on the tube, while the other side is mounted on the boss part. A protective protrusion protruding outward in a radial direction of the boss part and protecting the boss part and the protective cover is provided on the boss part. The protective cover is formed having a plate shape by a material having elasticity, and the protective cover includes a plate part for protecting the rod between the cover guide and the boss part and a winding part formed so as to be wound around an outer periphery of the boss part from a distal end side of the plate part. A protective protrusion engaging hole into which the protective protrusion is engaged is provided in the winding part at a position corresponding to the protective protrusion.

SUMMARY OF THE DISCLOSURE

In one aspect of the present disclosure, a cylinder protection device for a cylinder of a machine is provided. The cylinder includes a cylindrical body. The cylinder protection device includes a first portion disposed on the cylindrical body. The first portion includes a first surface and a second surface. The first and second surfaces are disposed between a first end and a second end of the first portion. The first and second surfaces are inclined relative to each other. Further, the first and second surfaces intersect at a first upper edge of the first portion. The cylinder protection device also includes a second portion disposed on the cylindrical body and connected to the second end of the first portion. The second portion includes a third surface and a fourth surface inclined relative to each other. Further, the third and fourth surfaces intersect at a second upper edge of the second portion. The second upper edge is inclined relative to the first upper edge of the first portion.

In another aspect of the present disclosure, a linkage assembly associated with a machine is provided. The linkage assembly includes a lift arm having a first end and a second end. The first end is connected to a frame of the machine. The linkage assembly also includes an implement member connected to the second end of the lift arm. The linkage assembly further includes at least one cylinder adapted to move at least one of the lift arm and the implement member. The at least one cylinder includes a cylindrical body. The linkage assembly further includes a cylinder protection device coupled to the cylindrical body of the at least one cylinder. The cylinder protection device includes a first portion disposed on the cylindrical body. The first portion includes a first surface and a second surface. The first and second surfaces are disposed between a first end and a second end of the first portion. The first and second surfaces are inclined relative to each other. Further, the first and second surfaces intersect at a first upper edge of the first portion. The cylinder protection device also includes a second portion disposed on the cylindrical body and connected to the second end of the first portion. The second portion includes a third surface and a fourth surface inclined relative to each other. Further, the third and fourth surfaces intersect at a second upper edge of the second portion. The second upper edge is inclined relative to the first upper edge of the first portion.

In yet another aspect of the present disclosure, a machine is provided. The machine includes a frame and a linkage assembly coupled to the frame of the machine. The linkage assembly includes a lift arm having a first end and a second end. The first end is connected to the frame of the machine. The linkage assembly also includes an implement member connected to the second end of the lift arm. The linkage assembly further includes at least one cylinder adapted to move at least one of the lift arm and the implement member. Then at least one cylinder includes a cylindrical body. The linkage assembly further includes a cylinder protection device coupled to the cylindrical body of the at least one cylinder. The cylinder protection device includes a first portion disposed on the cylindrical body. The first portion includes a first surface and a second surface. The first and second surfaces are disposed between a first end and a second end of the first portion. The first and second surfaces are inclined relative to each other. Further, the first and second surfaces intersect at a first upper edge of the first portion. The cylinder protection device also includes a second portion disposed on the cylindrical body and connected to the second end of the first portion. The second portion includes a third surface and a fourth surface inclined relative to each other. Further, the third and fourth surfaces intersect at a second upper edge of the second portion. The second upper edge is inclined relative to the first upper edge of the first portion.

Other features and aspects of this disclosure will be apparent from the following description and the accompanying drawings.

DETAILED DESCRIPTION

Wherever possible, the same reference numbers will be used throughout the drawings to refer to the same or the like parts. Also, corresponding or similar reference numbers will be used throughout the drawings to refer to the same or corresponding parts.

Figure 1:
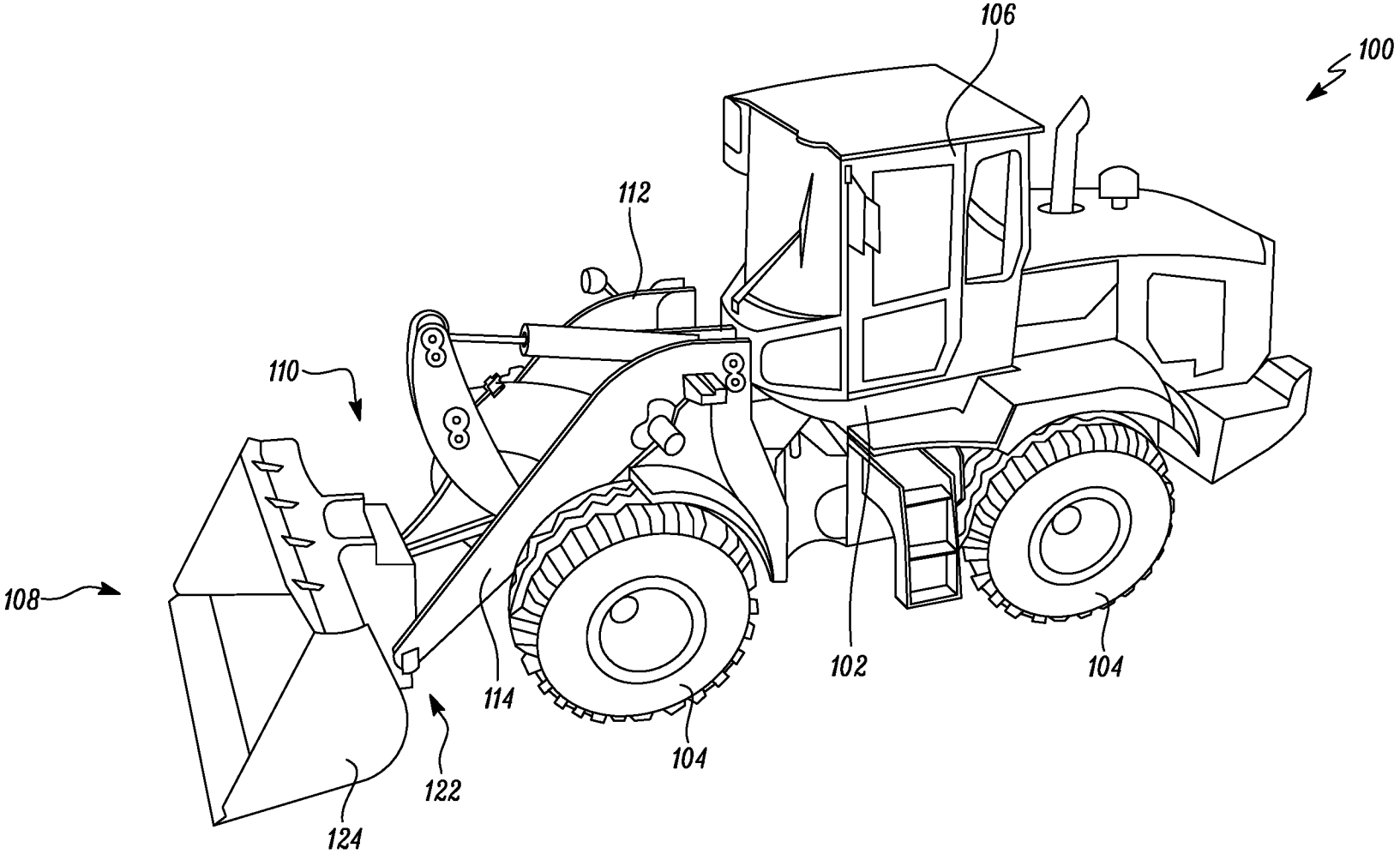
FIG. 1 is a perspective view of an exemplary machine.

FIG. 1 illustrates a perspective view of a machine 100, according to an embodiment of the present disclosure. In the illustrated embodiment, the machine 100 is embodied as a wheel loader. In alternative embodiments, the machine 100 may include a track type tractor, an excavator, a dozer, a harvester, a backhoe loader, a skid steer loader, or any other type of machine known in the art. The machine 100 may perform one or more than one type of operation associated with an industry, such as mining, construction, farming, transportation, or any other industry known in the art.

The machine 100 includes a frame 102. The frame 102 rotatably supports a set of ground engaging members 104 each of which is a wheel in the illustrated embodiment of FIG. 1. The ground engaging members 104 rotate about their respective axes thereby propelling the machine 100 on a ground surface. Alternatively, it can be contemplated to embody the set of ground engaging members 104 in the form of tracks (not shown) such that the tracks propel the machine 100. Further, the machine includes an operator cab 106 mounted on the frame 104. An operator of the machine 100 may be present within the operator cab 106 for operating the machine 100.

The machine 100 includes a linkage assembly 108 coupled to the frame 102 at a rear end 110 of the machine 100. The linkage assembly 108 includes a pair of lift arms 112, 114. Each of the lift arms 112, 114 define a first end 116, 118 and a second end 120, 122. The first ends 116, 118 of the respective lift arms 112, 114 are pivotably coupled to the frame 102. Further, the second ends 120, 122 of the respective lift arms 112, 114 are pivotably coupled to an implement member 124. The implement member 124 performs various tasks at a worksite. The worksite may include, for example, a mine site, a landfill, a quarry, a construction site, or any other type of worksite. The implement member 124 may engage, penetrate, or cut a surface of the worksite and/or move earth to accomplish a predetermined task. Moving the earth may be associated with altering a geography at the worksite and may form a part of a main job function, for example, a digging operation, a grading operation, a scraping operation, a leveling operation, a bulk material removal operation, a scooping operation, or any other type of geography altering operation at the worksite. Further, the implement member 124 also hold material therein for transportation of the held material from one location to another.

In the illustrated embodiment, the implement member 124 is a bucket that is pivotally coupled to the lift arms 112, 114. Although a bucket is disclosed herein, it should be noted that a type of the implement member 124 disclosed herein may vary from one application to another depending on specific requirements of an application. Therefore, it may be noted that the type of implement member 124 disclosed herein is non-limiting of this disclosure. Other types of implement members, such as a blade, may be implemented in place of the bucket depending on specific requirements of an application.

Figure 2:
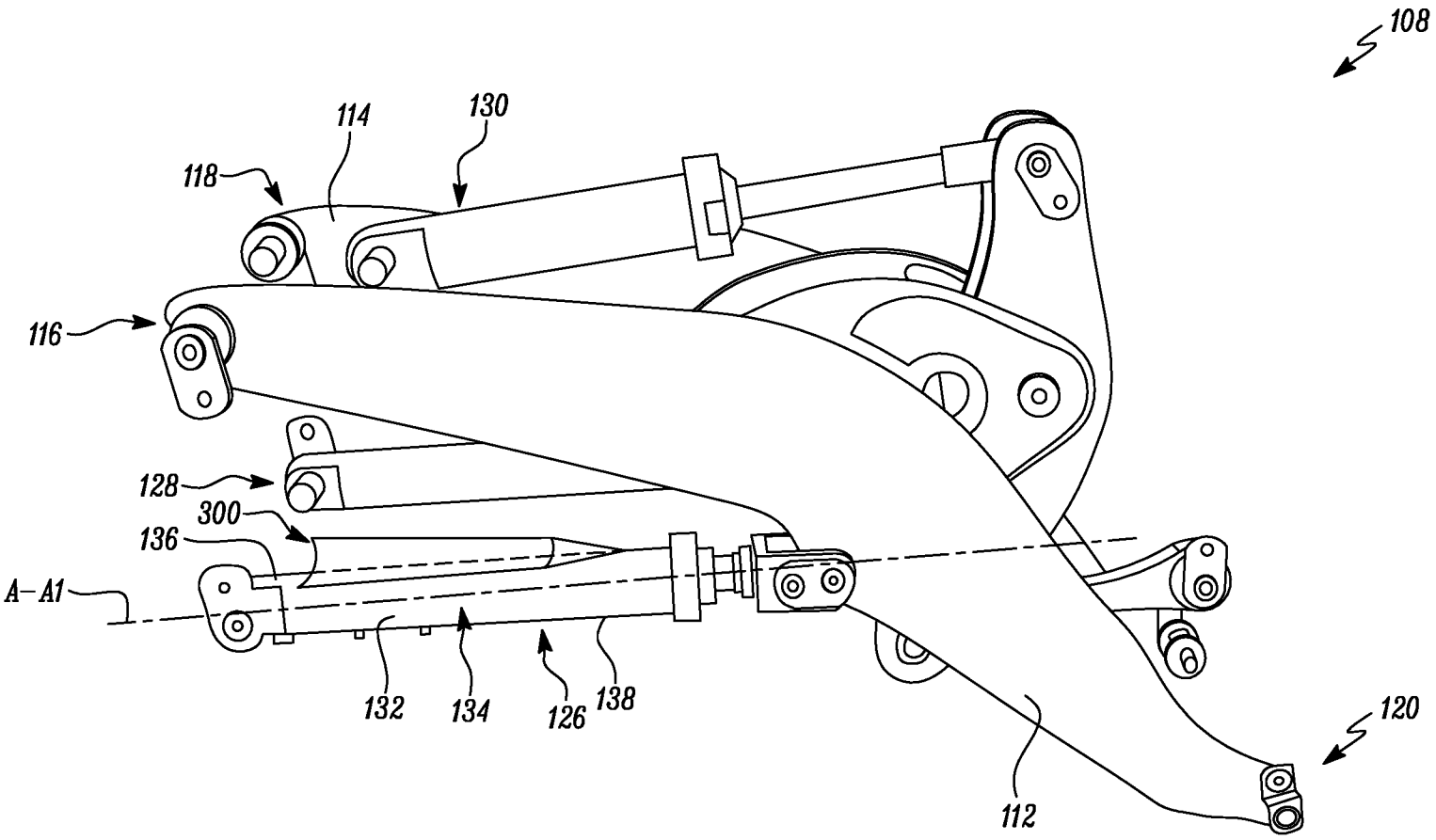
FIG. 2 is a perspective view of a linkage assembly associated with the machine of FIG. 1.

During operation of the machine 100, the lift arms 112, 114 and the implement member 124 may be moved to different positions. As shown in FIG. 2, the movement of the lift arms 112, 114 and/or the implement member 124 (shown in FIG. 1) is controlled by cylinders 126, 128, 130 which are coupled to these parts. More particularly, the machine 100 includes the lift cylinders 126, 128 pivotally coupled to the frame 102. The lift cylinders 126, 128 are coupled between the frame 102 and the respective lift arms 112, 114 for lowering and raising the lift arms 112, 114 relative to the frame 102. Further, the implement member 124 may be pivoted relative to the lift arms 112, 114 by means of the tilt cylinder 130 connected between the lift arms 112, 114 and the implement member 124. Although a single tilt cylinder 130 is shown herein, the linkage assembly may include more than one tilt cylinder.

It should be noted that each of the lift cylinders 126, 128 and the tilt cylinder 130 are of the same type. For example, each of the cylinders 126, 128, 130 may include a hydraulic cylinder. Alternatively, each of the cylinders 126, 128, 130 may include a pneumatic cylinder. Further, each of the cylinders 126, 128, 130 have similar components and are similar in construction and operation. Thus, for explanatory purposes, the lift cylinder 126 will now be explained in detail. However, it should be noted that the description provided below is equally applicable to the other cylinders 128, 130 of the machine 100, without any limitations.

The lift cylinder 126 includes a cylindrical body 132 defining a hollow passage 134. One end of the cylindrical body 132 is pivotally coupled to the frame 102 of the machine 100. The cylindrical body 132 defines a central axis "A-A1". Further, the cylindrical body 132 defines an upper portion 136 and a lower portion 138 with respect to the central axis "A-A1". The lift cylinder 126 includes a piston 140 that is reciprocatively received within the hollow passage 134 of the cylindrical body 132. The lift cylinder 126 also includes a rod member 142. The rod member 142 reciprocates with the piston 140. A portion of the rod member 142 is received within the hollow passage 134 of the cylindrical body 132. One end of the rod member 142 is connected to the piston 140 and another end of the rod member 142 is connected to the lift arm 112.

Figure 3:
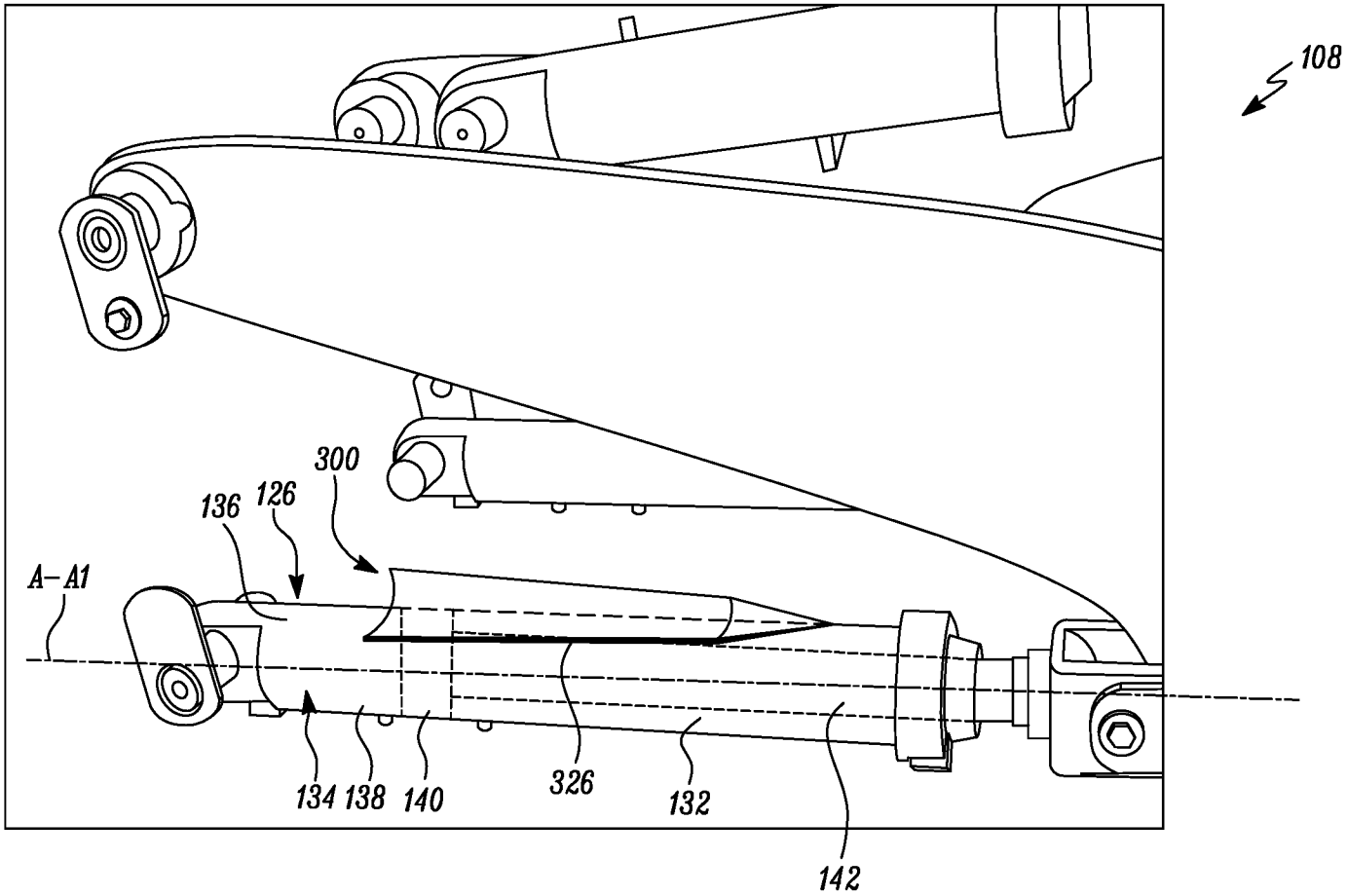
FIG. 3 is a perspective view of a portion of the linkage assembly shown in FIG. 2 illustrating a cylinder and a cylinder protection device, according to one embodiment of the present disclosure.
Figure 9:
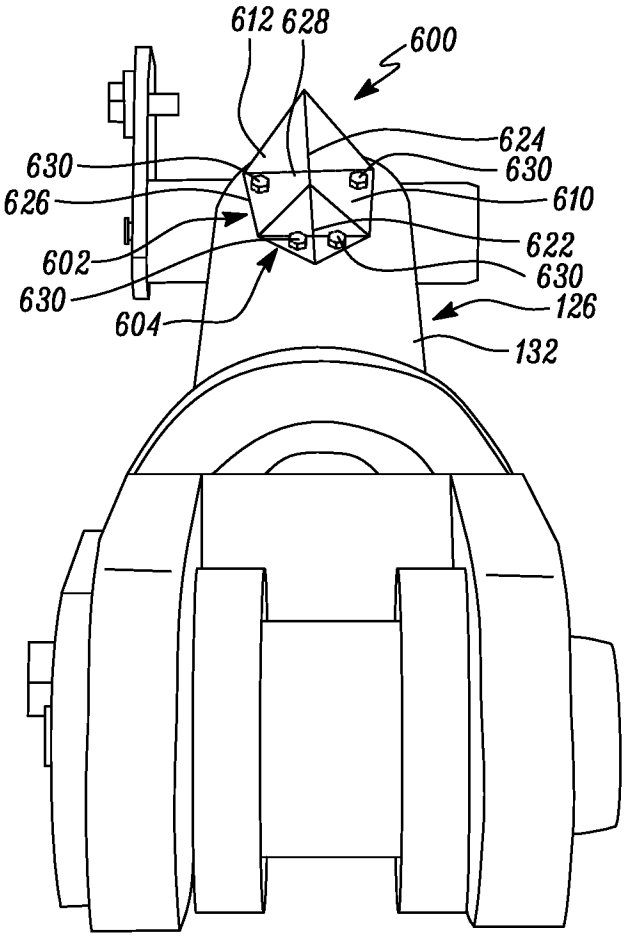
FIG. 9 is a perspective view of another design of a cylinder protection device, according to an embodiment of the present disclosure.
Figure 10:
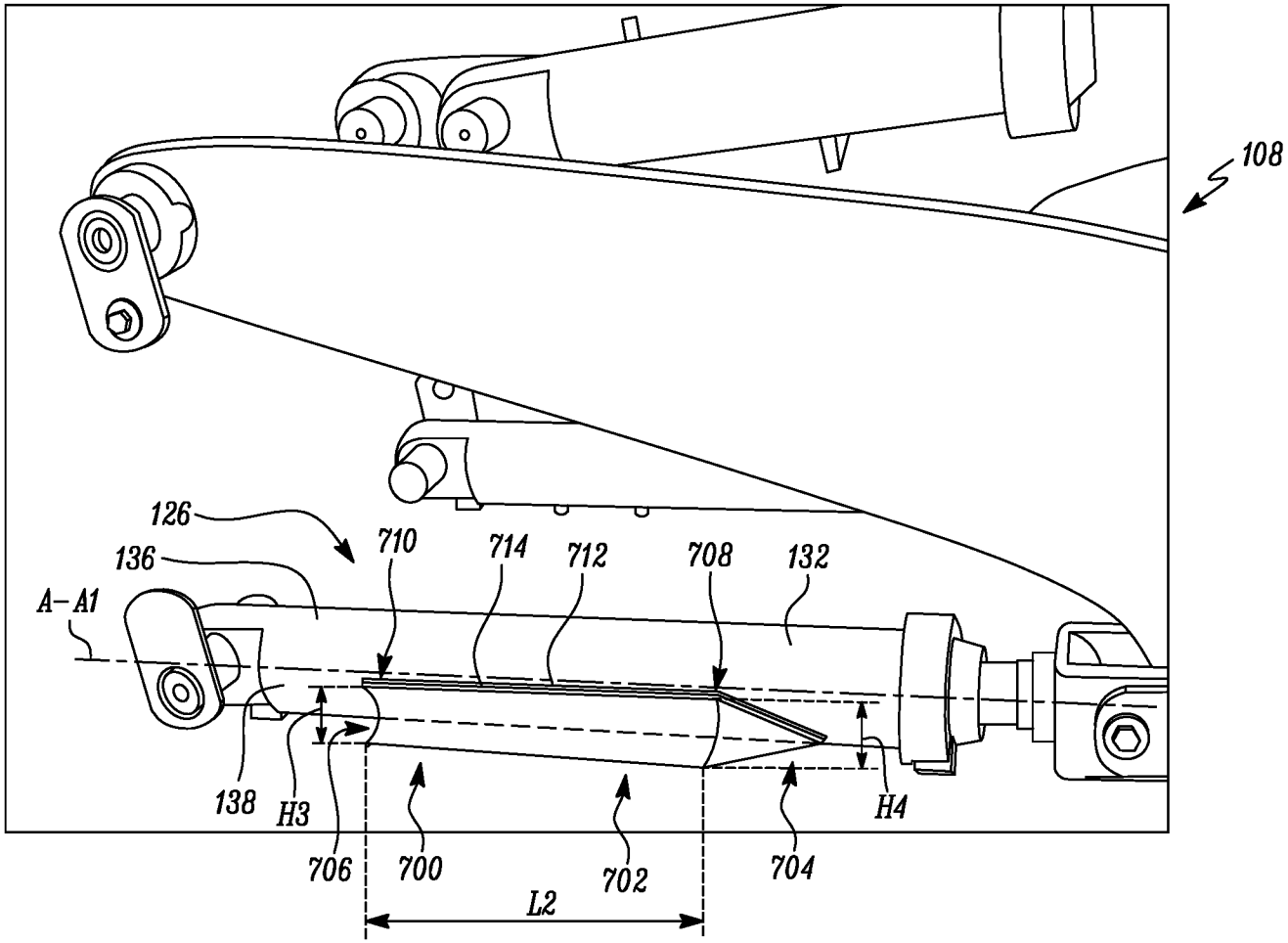
FIG. 10 is a perspective view of a portion of the linkage assembly shown in FIG. 2 illustrating the cylinder and a cylinder protection device, according to another embodiment of the present disclosure.

During machine operation, the lift cylinder 126 is subjected to bending due to material build-up on the lift cylinder 126. For example, the material may accumulate on the upper or lower portions 136, 138 of the lift cylinder 126 or on the rod member 142. In order to prevent the build-up of the material on the lift cylinder 126, the lift cylinder 126 includes a cylinder protection device 300, 600, 700. The cylinder protection device 300, 600, 700 is coupled with the cylindrical body 132. In one example, the cylinder protection device 300, 600 is coupled with the upper portion 136 of the cylindrical body 132. FIGS. 3 and 9 illustrate an example wherein the cylinder protection device 300, 600 is coupled with the upper portion 136 of the cylindrical body 132. In another example, the cylinder protection device 700 is coupled with the lower portion 138 of the cylindrical body 132. FIG. 10 illustrates an example wherein the cylinder protection device 700 is coupled with the lower portion 138 of the cylindrical body 132.

Figure 4:
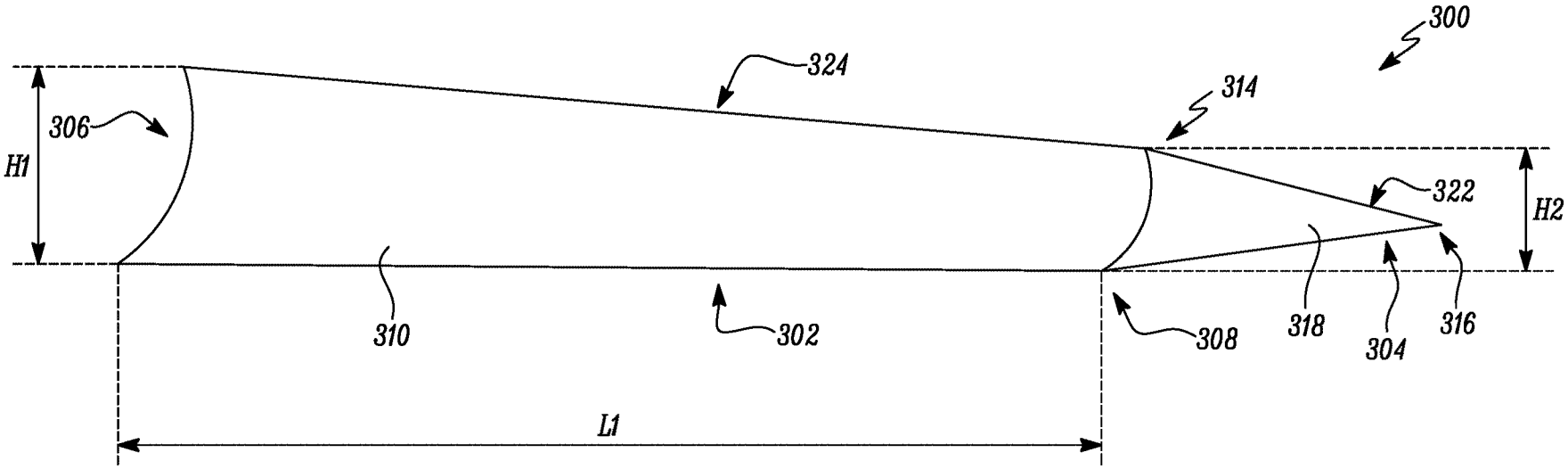
FIG. 4 is a perspective view of the cylinder protection device shown in FIG. 3.

The cylinder protection device 300 that is coupled with the upper portion 136 of the cylindrical body 132 will now be explained in detail. When the cylinder protection device 300 is coupled with the cylindrical body 132, the cylinder protection device 300 extends along the central axis "A-A1". As shown in FIG. 4, the cylinder protection device 300 includes a first portion 302 and a second portion 304. The first portion 302 includes a first end 306 and a second end 308.

Figure 5:
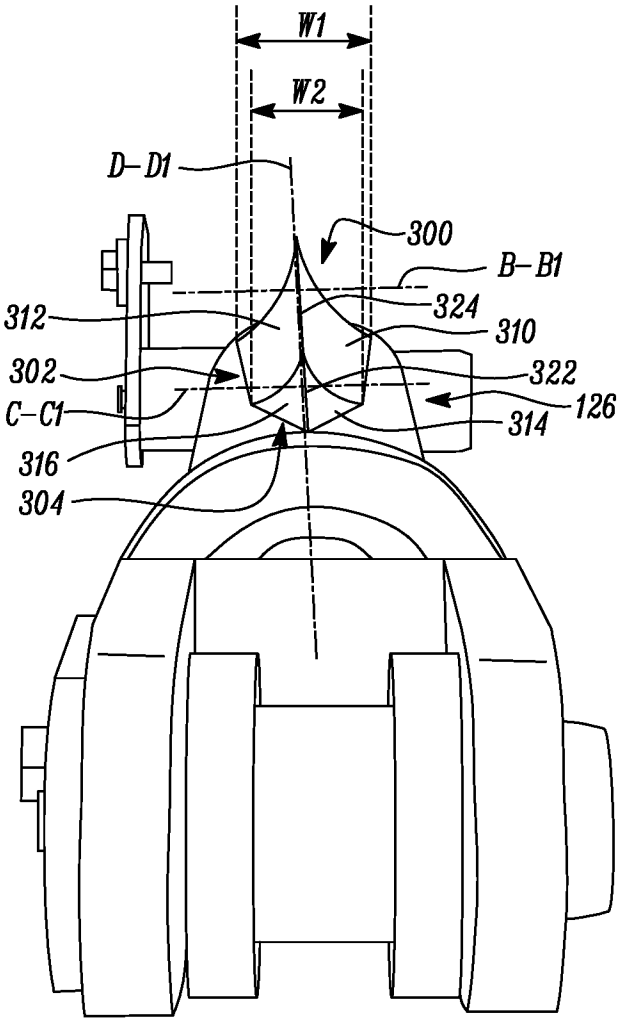
FIG. 5 is a rear view of the cylinder and the cylinder protection device shown in FIG. 3.

In the illustrated example, the first portion 302 tapers from the first end 306 towards the second end 308. More particularly, a height "H2" of the second end 308 is lesser than a height "H1" of the first end 306. The height "H2" is lesser than the height "H1" so that sufficient clearance is maintained between the cylinder protection device 300 and the lift arm 112 and the cylinder protection device 300 does not interfere with the operation of the linkage assembly 108. Alternatively, the height "H1" may be equal to the height "H2" such that first portion 302 of the cylinder protection device 300 has a uniform height along a length "L1" of the first portion 302. Referring now to FIG. 5, a width "W1" defined at the first end 306 (see FIG. 4) of the first portion 302 is greater than a width "W2" defined at the second end 308 (see FIG. 4) of the first portion 302. Alternatively, the first portion 302 may have a uniform width across the length "L1" (see FIG. 4) of the first portion 302.

Figure 6:
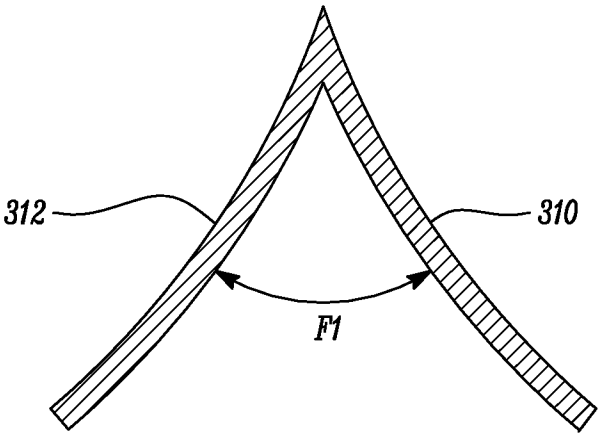
FIG. 6 is a cross-sectional view of the cylinder protection device of FIG. 5 across section B-B1.

Further, the first portion 302 includes a first surface 310 and a second surface 312. The first and second surfaces 310, 312 are disposed between the first end 306 and the second end 308 of the first portion 302. The first and second surfaces 310, 312 are inclined relative to each other. In one example, a first angle "F1" (shown in FIG. 6) defined between the first and second surfaces 310, 312 lies between 1 degree and 90 degrees. In another example, the first angle "F1" lies between 90 degrees and 180 degrees. In some examples, a value of the first angle "F1" may vary along the length "L1" of the first portion 302.

The first and second surfaces 310, 312 intersect at a first upper edge 324 of the first portion 302. The first and second surfaces 310, 312 of the cylinder protection device 300 are designed such that the first and second surfaces 310, 312 prevent the build-up of the material on the lift cylinder 126 by directing the material away from the lift cylinder 126. More particularly, an inclined profile of the first and second surfaces 310, 312 allows removal of the material falling towards the cylinder 126. In the illustrated example, the first and second surfaces 310, 312 are embodied as concave surfaces such that a curved slope defined by each of the first and second surfaces 310, 312 causes the material falling on the first and second surfaces 310, 312 to slide off and fall away from the lift cylinder 126.

Referring to FIG. 4, the cylinder protection device 300 also includes the second portion 304 connected to the first portion 302. The second portion 304 extends from the second end 308 of the first portion 302. In one example, the second portion 304 may be integrally manufactured with the first portion 302. In another example, the second portion 304 and the first portion 302 may be manufactured as separate components that are joined together by a known joining process, such as welding, soldering, brazing, and the like. A height of the second portion 304 defined at a first end 314 of the second portion 304 is equal to the height "H2" of the second end 308. Further, the height reduces from the first end 314 towards a second end 316 of the second portion 304 in order to maintain sufficient clearance above the second portion 304. As shown in FIG. 5, a width of the second portion 304 defined at the first end 314 (see FIG. 4) corresponds to the width "W2" of the second end 308 (see FIG. 4) and the width reduces from the first end 314 towards the second end 316.

Figure 7:
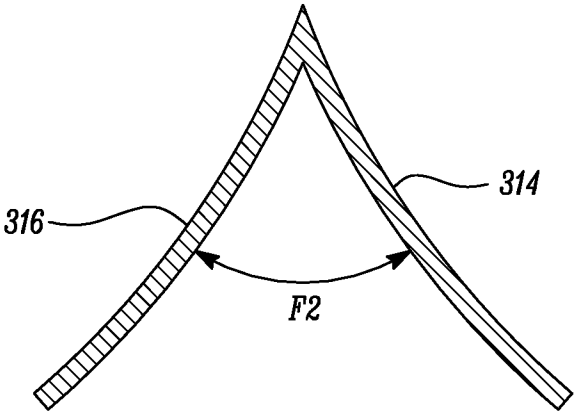
FIG. 7 is a cross-sectional view of the cylinder protection device of FIG. 5 across section C-C1.

The second portion 304 includes a third surface 318 and a fourth surface 320. The third and fourth surfaces 318, 320 are disposed between the first end 314 and the second end 316 of the second portion 304. The third and fourth surfaces 318, 320 are inclined relative to each other. In one example, a second angle "F2" (shown in FIG. 7) defined between the third and fourth surfaces 318, 320 lies between 1 degree and 90 degrees. In another example, the second angle "F1" lies between 90 degrees and 180 degrees. In some examples, a value of the second angle "F2" may vary along a length of the second portion 304. In the illustrated example, the third and fourth surfaces 318, 320 are embodied as concave surfaces such that the third and fourth surfaces 318, 320 allow the material that falls on the third and fourth surfaces 318, 320 to slide off and fall away from the lift cylinder 126. More particularly, an inclined profile of the third and fourth surfaces 318, 320 allows removal of the material falling towards the cylinder 126. Alternatively, each of the third and fourth surfaces 318, 320 may have a planar surface.

Figure 8:
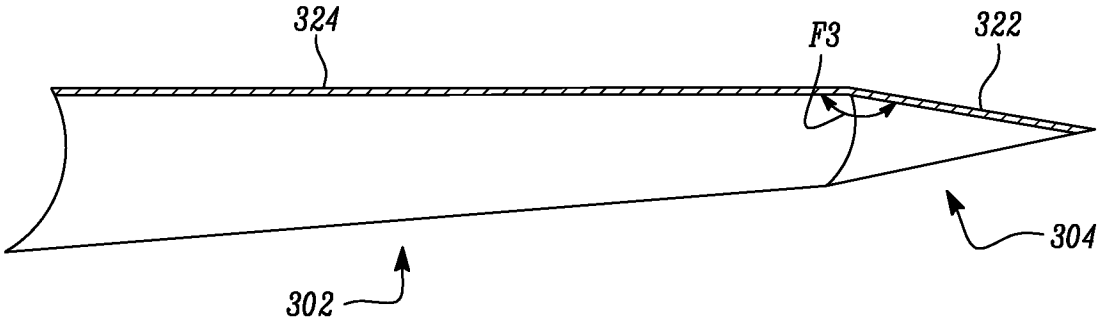
FIG. 8 is a cross-sectional view of the cylinder protection device of FIG. 5 across section D-D1.

Further, the third and fourth surfaces 318, 320 intersect at a second upper edge 322 of the second portion 304. The second upper edge 322 is inclined relative to the first upper edge 324 of the first portion 302. A third angle "F3" (shown in FIG. 8) is defined between the first upper edge 324 and the second upper edge 322. The third angle "F3" may lie between 90 degrees and 180 degrees. The second upper edge 322 of the second portion 304 extends from the first upper edge 324 of the first portion 302 towards the cylindrical body 132. As shown, the second upper edge 322 includes a straight edge. Alternatively, the second upper edge 322 may include a concave edge, without any limitations. It should be noted that in some examples, the cylinder protection device 300 may omit the second portion 304 and only include the first portion 302.

The cylinder protection device 300 described herein may be manufactured of a metal or a non-metal. In one example, the cylinder protection device 300 may be made from plastic. Alternatively, the cylinder protection device 300 may be made from a metal such as aluminum, or any other light weight metal. Further, the cylinder protection device 300 may be manufactured using a 3D printing process. Alternatively, the cylinder protection device 300 may be manufactured using any other manufacturing process such as molding, casting, and the like, without any limitations.

Further, in the illustrated example, the cylinder protection device 300 is coupled to the cylindrical body 132 using an adhesive. More particularly, an adhesive layer 326 is provided between the cylinder protection device 300 and the cylindrical body 132 for coupling the cylinder protection device 300 with the cylindrical body 132. The adhesive layer 326 may include, for example, an industrial adhesive, an adhesive tape, or epoxy. In another example, hook and loop fasteners or tie straps may be used to couple the cylinder protection device 300 and the cylindrical body 132. In yet another example, mechanical fasteners, such as bolts, screw, rivets, and the like, may be used to couple the cylinder protection device 300 with the cylindrical body 132. Further, mechanical joining techniques, such as welding, brazing, or soldering, may also be used to couple the cylinder protection device 300 with the cylindrical body 132. Further, in a situation wherein the cylinder protection device 300 gets damaged, the cylindrical body 132 may be cleaned to couple a replacement cylinder protection device with the cylindrical body 132. More particularly, the adhesive layer 626 that couples the cylinder protection device 300 with the cylindrical body 132 may be scraped off before coupling the replacement cylinder protection device.

FIG. 9 illustrates another embodiment of the cylinder protection device 600. The cylinder protection device 600 is similar to the cylinder protection device 300 shown in FIGS. 3, 4, and 5. The cylinder protection device 600 includes a first portion 602 having a first surface 610 and a second surface 612. In the illustrated embodiment, the first portion 602 includes a triangular cross-section, such that the first and second surfaces 610, 612 are embodied as planar surfaces that extend between a first upper edge 624 of the first portion 602 and a bottom surface 626 of the first portion 602. The planar slope defined by the first and second surfaces 610, 612 causes the material falling on the first and second surfaces 610, 612 to slide off and fall away from the lift cylinder 126. Further, the cylinder protection device 600 includes a second portion 604 that is similar to the second portion 304 of the cylinder protection device 300 shown in FIGS. 3, 4, and 5.

Further, in the illustrated example, the cylinder protection device 600 is coupled to the cylindrical body 132 using mechanical fasteners 630. More particularly, the cylinder protection device 600 includes a plate member 628 provided at a lower end of the cylinder protection device 600. The plate member 628 includes a number of apertures (not shown) that align with a number of apertures (not shown) in the cylindrical body 132 to receive the mechanical fasteners 630. The mechanical fasteners 630 may include any one of bolts, screws, rivets, pins, and the like. As illustrated, the cylinder protection device 600 includes four mechanical fasteners 630. However, a total number of mechanical fasteners 630 may vary based on dimensions of the cylinder protection device 600.

Alternatively, the cylinder protection device 600 may be coupled to the cylindrical body 132 using an adhesive layer similar to the adhesive layer 326 explained in reference to FIG. 3. In another example, hook and loop fasteners or tie straps may be used to couple the cylinder protection device 600 with the cylindrical body 132. Further, mechanical joining techniques, such as welding, brazing, or soldering, may also be used to couple the cylinder protection device 600 with the cylindrical body 132.

FIG. 10 illustrates another embodiment of the cylinder protection device 700 in which the cylinder protection device 700 is coupled to the lower portion 138 of the cylindrical body 132. The cylinder protection device 700 is similar to the cylinder protection device 300 shown in FIGS. 3, 4, and 5. The cylinder protection device 700 includes a first portion 702. The first portion 702 includes a first end 706 and a second end 708. In the illustrated example, the first portion 702 tapers from the second end 708 towards the first end 706. More particularly, a height "H3" of the first end 706 is lesser than a height "H4" of the second end 708. The height "H3" is lesser than the height "H4" so that the cylinder protection device 700 prevents any build-up of material build from a bottom side of the machine 100 when the lift cylinder 126 is close to a structure underneath it. Alternatively, the height "H3" may be equal to the height "H4" such that first portion 702 of the cylinder protection device 700 has a uniform height along a length "L2" of the first portion 702. Further, the cylinder protection device 700 includes a second portion 704 that is similar to the second portion 304 of the cylinder protection device 300 shown in FIGS. 3, 4, and 5.

Further, in the illustrated example, the cylinder protection device 700 is coupled to the cylindrical body 132 using a hook and loop fastener 710. More particularly, the cylinder protection device 700 includes first sheet 712 having a number of small hooks and a second sheet 714 having a number of small loops. The first sheet 712 is coupled with the cylindrical body 132 whereas the second sheet 714 is coupled to a plate member (not shown) of the cylinder protection device 700. The plate member is similar to the plate number 628 explained in reference to FIG. 9. Further, when the cylinder protection device 700 is pressed towards the cylindrical body 132, the hooks on the first sheet 712 engage with the loops on the second sheet 714 to couple the cylinder protection device 700 with the cylindrical body 132.

Alternatively, the cylinder protection device 700 may be coupled to the cylindrical body 132 using an adhesive layer similar to the adhesive layer 326 explained in reference to FIG. 3. In another example, mechanical fasteners similar to the mechanical fasteners 630 explained in reference to FIG. 9 may be used to couple the cylinder protection device 700 and the cylindrical body 132. In yet another example, tie straps or mechanical joining techniques, such as welding, brazing, or soldering, may be used to couple the cylinder protection device 700 with the cylindrical body 132.

It should be noted that the cylinder protection device 300, 600, 700 disclosed herein may also be coupled with the cylinder 128, 130 or any other cylinder of the machine 100 that is exposed to construction environment and the falling material, without limiting the scope of the present disclosure

INDUSTRIAL APPLICABILITY

The present disclosure relates to the cylinder protection device 300, 600, 700 that prevents the build-up of the material on the cylinders 126, 128, 130 by directing the material away from the cylinders 126, 128, 130. Further, the cylinder protection device 300, 600, 700 acts as a sacrificial component that protects the cylinders 126, 128, 130 from damage caused by heavy objects, such as large rocks or other stiff objects that are caught between the cylinders 126, 128, 130 and the cylinder protection device 300, 600, 700. The cylinder protection device 300, 600, 700 is simple in design, manufacturing, and installation.

As the cylinder protection device 300, 600, 700 is manufactured from a low-cost material and using low cost production techniques, the cylinder protection device 300, 600, 700 described herein provides a cost-effective solution for protection of the cylinders 126, 128, 130. Further, the cylinder protection device 300, 600, 700 is removably coupled to the cylinders 126, 128, 130. Thus, the cylinder protection device 300, 600, 700 can be easily removed and replaced by another cylinder protection device 300, 600, 700, as per requirements. Additionally, the cylinder protection device 300, 600, 700 can be retrofitted to an existing machine.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A cylinder protection device for a cylinder of a machine, the cylinder including a cylindrical body having a central axis, the cylinder protection device comprising:

a first portion disposed on the cylindrical body and including a first surface and a second surface, the first and second surfaces disposed between a first end and a second end of the first portion, wherein the first and second surfaces are inclined relative to each other, the first and second surfaces intersecting at a first upper edge of the first portion; and a second portion disposed on the cylindrical body and connected to the second end of the first portion, wherein the second portion includes a third surface and a fourth surface inclined relative to each other, the third and fourth surfaces intersecting at a second upper edge of the second portion, wherein the first upper edge, the second upper edge and the central axis are co-planar when the cylinder protection device is installed on the cylinder, and wherein the second upper edge is inclined relative to the first upper edge of the first portion.

2. The cylinder protection device of claim 1, wherein the cylindrical body defines an upper portion and a lower portion with respect to a central axis of the cylindrical body, wherein the cylinder protection device is removably coupled to at least one of the upper portion and the lower portion of the cylindrical body.

3. The cylinder protection device of claim 1, wherein each of the first surface and the second surface include at least one of a concave surface and a planar surface.

4. The cylinder protection device of claim 1, wherein the first portion of the cylinder protection device tapers from the first end towards the second end.

5. The cylinder protection device of claim 1, wherein the first portion of the cylinder protection device tapers from the second end towards the first end.

6. The cylinder protection device of claim 1, wherein the cylinder protection device has a uniform height along a length of the first portion.

7. The cylinder protection device of claim 1, wherein the second upper edge of the second portion extends from the first upper edge of the first portion towards the cylindrical body.

8. The cylinder protection device of claim 1, wherein the second upper edge of the second portion includes at least one of a concave edge and a straight edge.

9. The cylinder protection device of claim 1, wherein each of the third surface and the fourth surface include at least one of a concave surface and a planar surface.

10. The cylinder protection device of claim 1, wherein the cylinder protection device is manufactured from at least one of a plastic and a metal.

11. The cylinder protection device of claim 1, wherein the cylinder protection device is coupled to the cylindrical body using at least one of adhesives, hook and loop fasteners, epoxy, and mechanical fasteners.

12. A linkage assembly associated with a machine, the linkage assembly comprising:

a lift arm having a first end and a second end, wherein the first end is connected to the machine;

an implement member connected to the second end of the lift arm;

at least one cylinder adapted to move at least one of the lift arm and the implement member, the at least one cylinder including a cylindrical body having a central axis; and a cylinder protection device coupled to the cylindrical body of the at least one cylinder, the cylinder protection device comprising:

a first portion including a first surface and a second surface, the first and second surfaces disposed between a first end and a second end of the first portion, wherein the first and second surfaces are inclined relative to each other, the first and second surfaces intersecting at a first upper edge of the first portion; and a second portion connected to the second end of the first portion, wherein the second portion includes a third surface and a fourth surface inclined relative to each other, the third and fourth surfaces intersecting at a second upper edge of the second portion, wherein the first upper edge, the second upper edge and the central axis are co-planar when the cylinder protection device is installed on the cylinder, and wherein the second upper edge is inclined relative to the first upper edge of the first portion.

13. The linkage assembly of claim 12, wherein the cylindrical body defines an upper portion and a lower portion with respect to a central axis of the cylindrical body, wherein the cylinder protection device is removably coupled to at least one of the upper portion and the lower portion of the cylindrical body.

14. The linkage assembly of claim 12, wherein each of the first surface and the second surface include at least one of a concave surface and a planar surface.

15. The linkage assembly of claim 12, wherein each of the third surface and the fourth surface include at least one of a concave surface and a planar surface.

16. The linkage assembly of claim 12, wherein the cylinder includes at least one of a hydraulic cylinder and a pneumatic cylinder.

17. A machine comprising:

a frame; and a linkage assembly coupled to the frame of the machine, the linkage assembly comprising:

a lift arm having a first end and a second end, wherein the first end connected to the machine;

an implement member connected to the second end of the lift arm;

at least one cylinder adapted to move at least one of the lift arm and the implement member, the at least one cylinder including a cylindrical body having a central axis; and a cylinder protection device coupled to the cylindrical body of the at least one cylinder, the cylinder protection device comprising:

a first portion including a first surface and a second surface, the first and second surfaces disposed between a first end and a second end of the first portion, wherein the first and second surfaces are inclined relative to each other, the first and second surfaces intersecting at a first upper edge of the first portion; and a second portion connected to the second end of the first portion, wherein the second portion includes a third surface and a fourth surface inclined relative to each other, the third and fourth surfaces intersecting at a second upper edge of the second portion, wherein the first upper edge, the second upper edge and the central axis are co-planar when the cylinder protection device is installed on the cylinder, and wherein the second upper edge is inclined relative to the first upper edge of the first portion.

18. The machine of claim 17, wherein the cylindrical body defines an upper portion and a lower portion with respect to a central axis of the cylindrical body, wherein the cylinder protection device is removably coupled to at least one of the upper portion and the lower portion of the cylindrical body.

19. The machine of claim 17, wherein each of the first surface and the second surface include at least one of a concave surface and a planar surface.

20. The machine of claim 17, wherein each of the third surface and the fourth surface include at least one of a concave surface and a planar surface.

* * * * *